US007937770B1

(12) United States Patent
Hernandez

(10) Patent No.: US 7,937,770 B1
(45) Date of Patent: May 10, 2011

(54) INFLATABLE SWIMSUIT

(76) Inventor: Marcos Hernandez, Bronx, NY (US)

( * ) Notice: Subject to any disclaimer, the term of this patent is extended or adjusted under 35 U.S.C. 154(b) by 480 days.

(21) Appl. No.: 12/104,174

(22) Filed: Apr. 16, 2008

(51) Int. Cl.
*A41D 7/00* (2006.01)

(52) U.S. Cl. ..... 2/67; 441/56; 441/108; 441/120

(58) Field of Classification Search ..... 2/67, 238; 441/120, 121, 122, 123, 102, 56, 93, 108
See application file for complete search history.

(56) References Cited

U.S. PATENT DOCUMENTS

| | | | | |
|---|---|---|---|---|
| 2,446,326 | A * | 8/1948 | Guithues | 2/238 |
| 3,130,424 | A * | 4/1964 | Santangelo | 441/94 |
| 3,771,172 | A | 11/1973 | Borg | |
| 3,838,471 | A | 10/1974 | Brolli | |
| 4,312,089 | A | 1/1982 | Taylor | |
| D269,220 | S | 6/1983 | Joseph | |
| 4,692,125 | A | 9/1987 | Wessman | |
| 5,413,485 | A * | 5/1995 | Adee | 434/254 |
| 5,466,179 | A | 11/1995 | Jeffrey, Sr. | |
| 5,778,451 | A * | 7/1998 | Rhea | 2/67 |
| 5,779,512 | A | 7/1998 | Rupert | |
| 6,036,562 | A | 3/2000 | Brown | |
| 6,088,832 | A | 7/2000 | Newman | |
| 6,374,412 | B1 | 4/2002 | Canlas | |
| 6,676,467 | B1 | 1/2004 | Filsouf | |
| 7,125,302 | B2 | 10/2006 | Haselsteiner | |
| 7,174,574 | B2 * | 2/2007 | Fontes | 2/235 |
| 2005/0138716 | A1 * | 6/2005 | Orsos | 2/67 |
| 2006/0073749 | A1 * | 4/2006 | Turner | 441/103 |
| 2006/0116656 | A1 * | 6/2006 | Hendren et al. | 604/396 |

FOREIGN PATENT DOCUMENTS

WO WO 2005/095203 10/2005

OTHER PUBLICATIONS

McNally, R., "Editor's Note. Design Time," Boating World, Jul. 2006, p. 12.

* cited by examiner

*Primary Examiner* — Gary L Welch
*Assistant Examiner* — Alissa J Tompkins
(74) *Attorney, Agent, or Firm* — Richard Pettus; Kyle M. Zeller; King & Spalding LLP

(57) ABSTRACT

The present invention relates to a swimsuit comprising swimming trunks, a compressed gas cylinder with a user-operated valve, and one or more inflatable bladders attached to the swimming trunks. The swimsuit, apart from its basic function as clothing, performs simultaneously as a protecting and rescuing device in a life-threatening situation.

1 Claim, 4 Drawing Sheets

Side View

Hook and loop
attachment pulls apart

INFLATABLE SWIMSUIT

FIELD OF INVENTION

The present invention relates to a swimsuit comprising swimming trunks, a compressed gas cylinder with a user-operated valve, and one or more inflatable bladders attached to the swimming trunks. The swimsuit, apart from its basic function as clothing, performs simultaneously as a protecting and rescuing device in a life-threatening situation.

BACKGROUND

Various forms of rescue equipment in the form of life-belts and life jackets designed for people in and around water are known in the art. In addition, various types of flotation aids for assisting young children as they learn to swim are available in the form of inflatable devices worn around the arms. For example, U.S. Pat. No. 5,466,179 describes a self inflatable flotation device in the form of a pouch adapted to be worn about the waist of a user until needed. U.S. Pat. No. 6,036,562 describes a swimmer's safety belt that inflates into a life preserver and a life vest. Alternatively, U.S. Pat. No. 7,125,302 describes a personal flotation device with an inflatable bladder assembly to be worn around the neck.

Despite the various forms of rescue equipment described in the art, there remains a need for a swimsuit that provides a protecting and rescuing function in a life-threatening situation.

SUMMARY

The present invention provides an inflatable swimsuit. In one embodiment, the swimsuit is an emergency device for someone enjoying recreational activities in and near water. Whereas traditional safety belts and life preservers are bulky and unfashionable, the present invention may be worn without drawing attention to the fact that it is an inflatable device.

In one embodiment, the invention is a swimsuit comprising: a waistband, swimming trunks connected to the waistband with an outer seam on each side and an inseam, an inner lining, a compressed $CO_2$ gas cylinder with a user-operated valve, four inflatable bladders attached to the swimming trunks and in communication with the gas cylinder and located between the inner lining and the swimming trunks, hook-and-loop fasteners along the outer seam and inseam of the trunks, and a purge valve wherein the purge valve is adapted to avoid rupture of the inflatable bladders upon inflation.

In another embodiment, the invention is a swimsuit comprising: swimming trunks, a compressed gas cylinder with a user-operated valve, and one or more inflatable bladders attached to the swimming trunks and in communication with the gas cylinder. Preferably, the swimsuit is designed such that the swimming trunks further comprise detachable fasteners forming one or more seams in the swimsuit. Even more preferably, the detachable fasteners are hook-and-loop fasteners. In an alternate embodiment, the seams in the swimsuit run along the outer sides of the swimming trunks and along the inseam.

In one embodiment of the swimsuit, the compressed gas cylinder contains $CO_2$ gas. The swimsuit according to the invention may have one or more inflatable bladders, and preferably may have four inflatable bladders attached to the swimming trunks. In a preferred embodiment, one inflatable bladder is attached to the swimming trunks at each front, back, left, and right position along the swimming trunks corresponding to the thigh of a person wearing the swimsuit. Preferably, the swimsuit according to the invention further comprises an inner lining.

In one embodiment, the swimsuit according to the invention forms a band or belt around the waist of the wearer with swimming trunks extending below the waist along the thighs of the wearer, inflatable bladders attached to the inside of the swimming trunks, an inner lining around the pelvis of the wearer, a compressed gas cylinder in communication with the inflatable bladders, a purge valve to avoid rupture of the inflatable bladders, and detachable fasteners along the seams of the swimming trunks. In a preferred embodiment of the swimsuit, upon activation of the compressed gas cylinder, the bladders are inflated, the detachable fasteners detach, and the swimsuit forms a band around the midsection of the wearer while the swimming trunks and inflated bladders are adapted to provide flotation assistance in water in front of and behind the wearer.

Additional embodiments are described in the detailed description of the invention.

DETAILED DESCRIPTION

The present invention provides an inflatable swimsuit. The swimsuit may provide a protection or rescue function in a life-threatening situation. Whereas traditional safety belts and life preservers are bulky and unfashionable, the present invention may be worn without drawing attention to the fact that it is an inflatable device. In one embodiment, the swimsuit is an emergency device for someone enjoying recreational activities in and near water. Such recreational activities may include, without limitation, swimming, boating, skiing, jet-skiing, sailing, parasailing, surfing, windsurfing, fishing, and any other activities that may bring one into contact with water. The swimsuit according to the invention may provide assistance or reassurance to a wearer who is fatigued, injured, or frightened in water, or may simply provide additional buoyancy to a wearer who desires additional buoyancy and seeks to avoid excess exertion in maintaining oneself while immersed in water.

Figure 1:
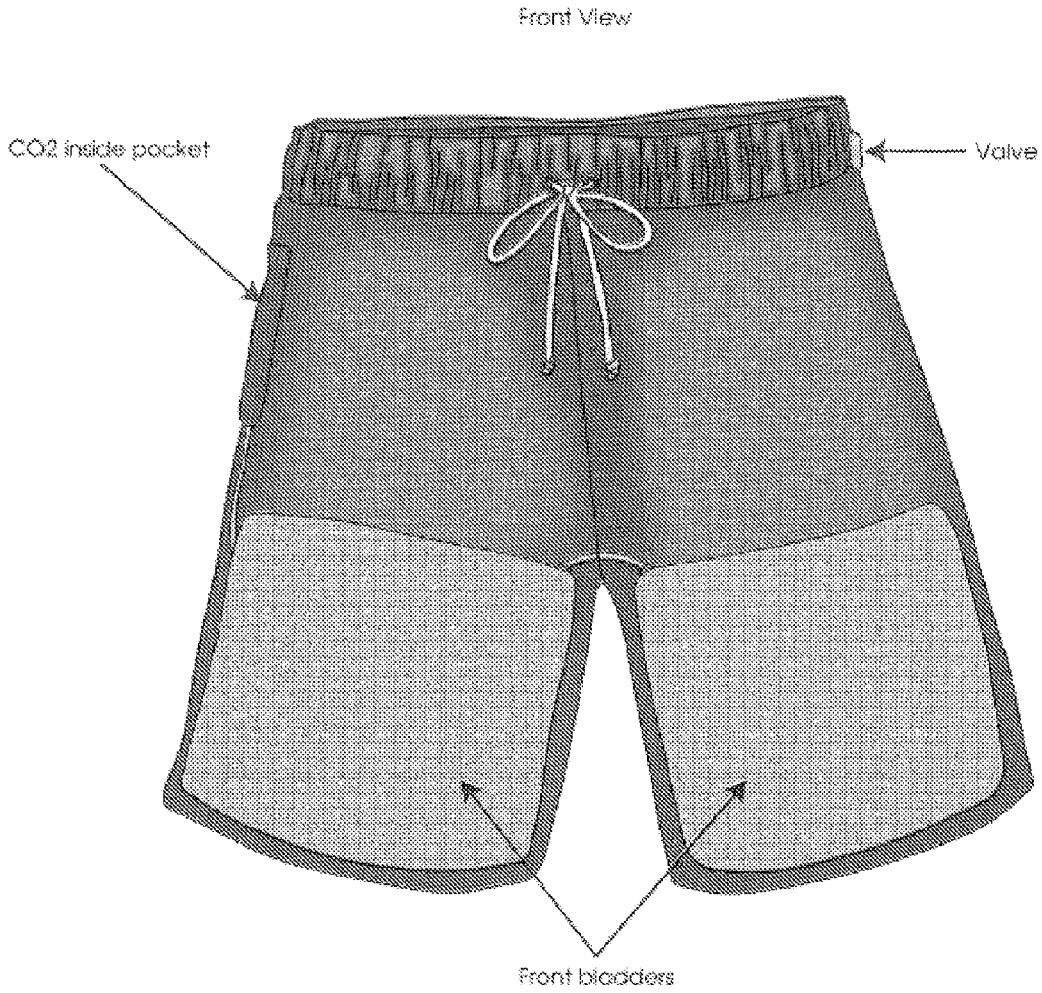
FIG. 1 shows an example of a front view of a swimsuit according to the invention.
Figure 2:
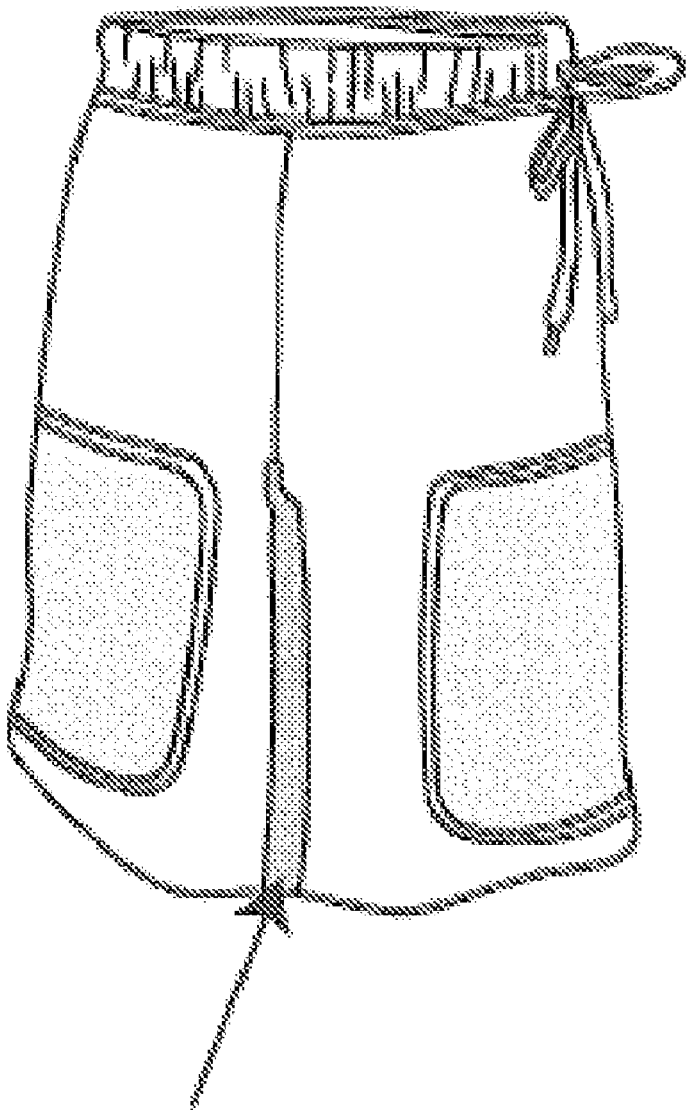
FIG. 2 shows an example of a side view of a swimsuit according to the invention.

In one embodiment, the invention is a swimsuit comprising: swimming trunks, a compressed gas cylinder with a user-operated valve, and one or more inflatable bladders attached to the swimming trunks and in communication with the gas cylinder (see FIGS. 1 and 2). The swimming trunks may be made of any material that is used for swimming trunks. Preferably, the swimming trunks are made of cotton, polyester, SPANDEX®, nylon, or any other traditional material used for swimming trunks. Preferably, the swimsuit according to the invention further comprises an inner lining. The inner lining may be a mesh lining. In a preferred embodiment, the swimsuit is in the knee-length surfer style of swimsuit, also referred to as board shorts.

In one embodiment, the swimsuit according to the invention forms a band or belt around the waist of the wearer with swimming trunks extending below the waist along the thighs of the wearer, inflatable bladders attached to the inside of the swimming trunks, an inner lining around the pelvis of the wearer, a compressed gas cylinder in communication with the inflatable bladders, a purge valve to avoid rupture of the inflatable bladders, and detachable fasteners along the seams of the swimming trunks. In a preferred embodiment of the swimsuit, upon activation of the compressed gas cylinder, the bladders are inflated, the detachable fasteners detach, and the swimsuit forms a band around the midsection of the wearer while the swimming trunks and inflated bladders are adapted to provide flotation assistance in water in front of and behind the wearer.

Figure 3:
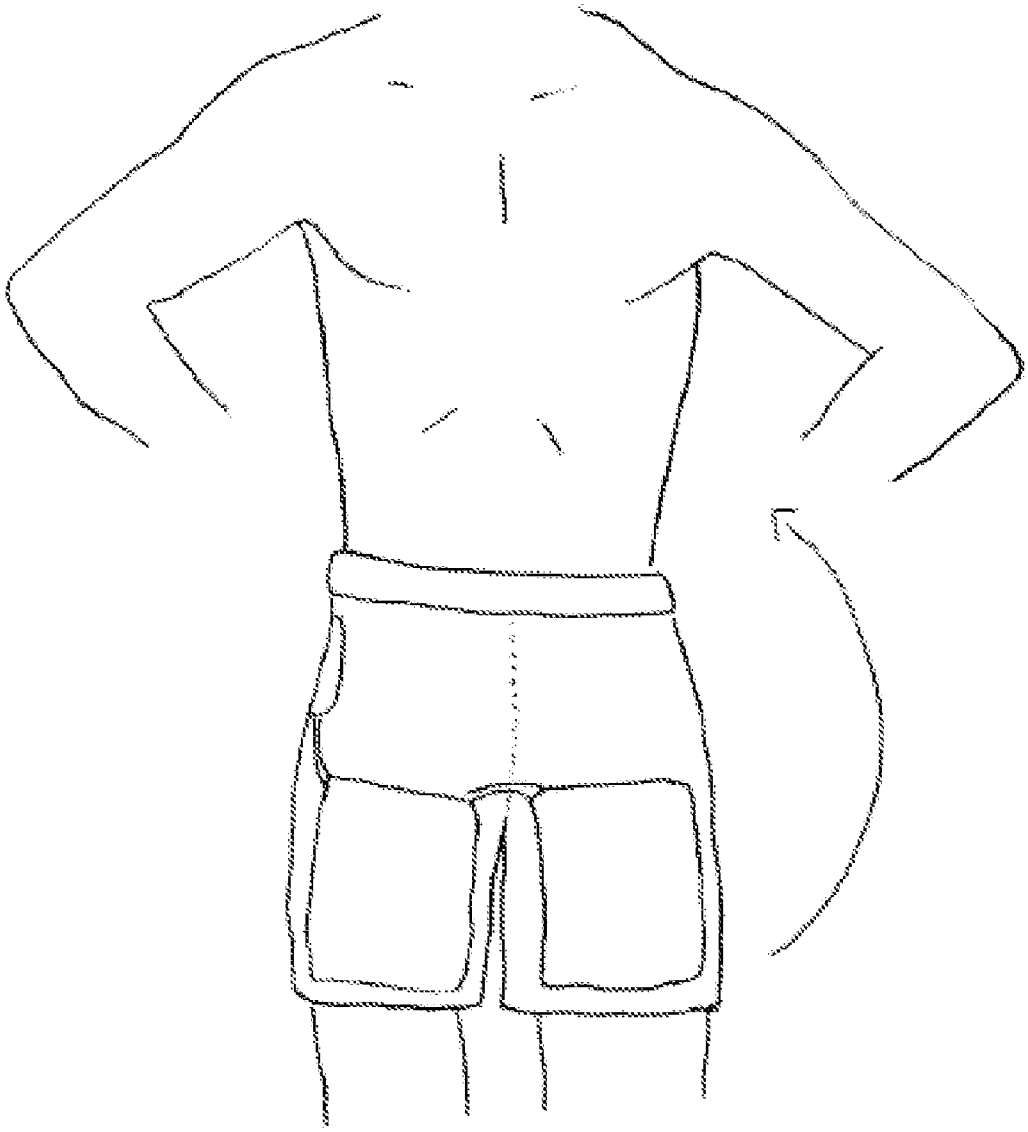
FIG. 3 shows an example of a swimsuit according to the invention prior to inflation.
Figure 4:
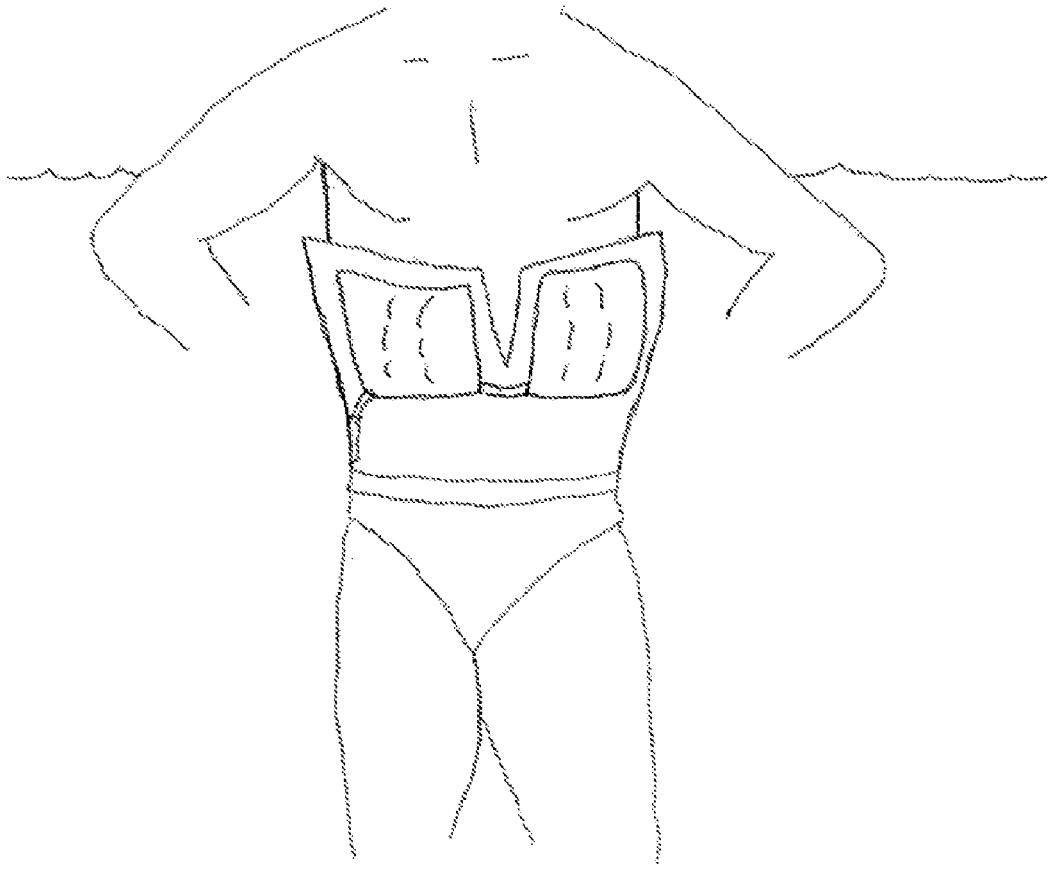
FIG. 4 shows an example of a swimsuit according to the invention after inflation.

Preferably, the swimsuit is designed such that the swimming trunks further comprise detachable fasteners forming one or more seams in the swimsuit. Even more preferably, the detachable fasteners are hook-and-loop fasteners such as VELCRO® type fasteners. Preferably, upon inflation of the bladders, the bladders expand and force the detachable fasteners to detach. In a preferred embodiment, the detachable seams in the swimsuit run along the outer sides of the swimming trunks from the lowest edge of the swimming trunks up to or near the waistband, but not including the waistband, and along the entire inseam, allowing the trunks of the suit to float free from the thighs of the wearer, and rise up to the chest and back of the wearer, respectively, while being held in place by the waistband of the swimsuit, which forms a band or belt around the waist of the wearer (see FIGS. 3 and 4). In a preferred embodiment, the inflated bladders provide buoyancy to the wearer while positioning the wearer in a vertical position in the water, allowing the wearer to maintain his or her head above water, even if fatigued, frightened, or injured. In one embodiment, where there are four bladders positioned on the front and back and left and right, the two front bladders have a larger capacity, and upon inflation, provide additional buoyancy to the front of the wearer so that when the wearer is positioned in a roughly vertical orientation, the wearer's face is positioned further away from the water.

In an alternate embodiment, the detachable fasteners run front-to-back in the middle of the swimsuit, such that upon inflation of the bladders and detachment of the fasteners, the trunks float free from the thighs of the wearer and rise up to provide flotation assistance along the sides of the wearer, respectively, while being held in place by the waistband of the swimsuit.

In one embodiment of the swimsuit, the compressed gas cylinder contains $CO_2$ gas. Alternatively, the compressed gas cylinder may contain nitrogen, compressed air, nitrous oxide, or any other gas which upon inflation of the bladders would provide buoyancy. Compressed gas cylinders are available commercially, and may also be referred to as gas cartridges. For example, compressed gas cylinders and cartridges are available commercially for inflation of car tires, bicycle tires, paintball guns, balloons, and for kitchen use. Commercial compressed gas products include the WHIP-IT® line of products and the BRASS EAGLE® line of products. In a preferred embodiment, the compressed cylinder is between about two to five inches long, and may placed in a pocket along the outer seam of the swimsuit.

The swimsuit according to the invention may have one or more inflatable bladders, and preferably may have four inflatable bladders attached to the swimming trunks. In a preferred embodiment, one inflatable bladder is attached to the swimming trunks at each front, back, left, and right position along the swimming trunks corresponding to the thigh of a person wearing the swimsuit. The bladders may be made of any airtight expandable material, such as natural or synthetic rubber, or the like. The bladder may be made of more than one material, or may be anchored to the swimming trunks, such that upon inflation, the bladder expands outward in one direction, maintaining its same size where attached to the swimming trunks, but expanding outward where not attached to the swimming trunks. Preferably, the bladders are made of durable material that will not rupture or be easily punctured upon regular use as part of a swimsuit. In a preferred embodiment, the bladders and swimsuit are reusable, and may be inflated and deflated more than once upon recharging the compressed gas cylinder.

In one embodiment, the invention is a swimsuit comprising: a waistband, swimming trunks connected to the waistband with an outer seam on each side and an inseam, an inner lining, a compressed $CO_2$ gas cylinder with a user-operated valve, four inflatable bladders attached to the swimming trunks and in communication with the gas cylinder and located between the inner lining and the swimming trunks, hook-and-loop fasteners along the outer seam and inseam of the trunks, and a purge valve wherein the purge valve is adapted to avoid rupture of the inflatable bladders upon inflation. In a preferred embodiment, the gas cylinder can be activated by the wearer rather than to inflate automatically. Alternatively, the gas cylinder may be activated by a companion or rescue personnel in the event the wearer is in distress or unable to activate the gas cylinder himself or herself. In a preferred embodiment, the gas cylinder is activated by pressing a button or toggle switch in the assembly to which the gas cylinder is attached which provides communication between the gas cylinder and the inflatable bladders. Preferably, the gas cylinder can be removed from the assembly if the wearer desires to wear the swimsuit while not engaged in activities near or in water. In one embodiment, the gas cylinder can be replaced after discharge, such that the swimsuit is reusable for repeated rounds of inflation and deflation.

In a preferred embodiment, the swimsuit also comprises a purge valve for deflation of the bladders. The purge valve may release excess air in the bladders to avoid excess pressure or rupture of the bladders, or may be used to completely deflate the bladders after use so that the bladders are ready for re-use. The purge valve may be automatically triggered by overinflation of the bladders, or may be activated by the wearer. In one embodiment, the purge valve is integrated into the gas cylinder assembly/activation switch. In an alternate embodiment, the purge valve is separate from the inflation mechanism to avoid accidental purging of the bladders while they are in use by a wearer in distress. In a preferred embodiment, the valve (i.e., purge valve) is located on the opposite side of the swimsuit from the gas cylinder (see FIG. 1), and is in communication with the gas cylinder assembly and/or bladders via a line in the waistband.

Modifications and variations of the present invention relating to the selection of design aspects of the swimsuit may be practiced by those skilled in the art from the foregoing detailed description of the invention. Such modifications and variations are intended to come within the scope of the appended claims.

The invention claimed is:

1. A swimsuit comprising:

a waistband, swimming trunks connected to the waistband with outer seams and an inseam, an inner lining connected to the waistband, a compressed CO2 gas cylinder with a user operated valve, four inflatable bladders attached to the swimming trunks and in communication with said gas cylinder and located between the inner lining and the swimming trunks, hook-and-loop fasteners along the outer seams and inseam of said trunks, and a purge valve wherein said purge valve is adapted to avoid rupture of the inflatable bladders upon inflation.

* * * * *